United States Patent [19]

Augé

[11] 4,391,198

[45] Jul. 5, 1983

[54] BIDIRECTIONAL DISPERSIBLE SHAPED-CHARGE MINE

[75] Inventor: Claude Augé, Bourges, France

[73] Assignee: Etat Francais, Paris, France

[21] Appl. No.: 233,496

[22] Filed: Feb. 11, 1981

[30] Foreign Application Priority Data

Feb. 11, 1980 [FR] France ..... 80 02907

[51] Int. Cl.[3] ..... F42B 23/24

[52] U.S. Cl. ..... 102/401

[58] Field of Search ..... 102/401, 425

[56] References Cited

U.S. PATENT DOCUMENTS 4,040,354 8/1977 Stern ..... 102/425

4,122,775 10/1978 Held ..... 102/401

4,252,062 2/1981 Auge ..... 102/401

*Primary Examiner*—Charles T. Jordan

*Attorney, Agent, or Firm*—Parkhurst & Oliff

[57] ABSTRACT

The invention concerns a shaped-charge mine the effect of which is directed along either of two opposite directions and which is capable of operating whatever the manner of laying it.

This mine comprises a charge contained within a substantially cylindrical housing to the ends of which two coverings are fastened. An impact-damping means is arranged around the housing. It is formed either of a layer of damping material on which there are fastened deployable tongues or of two disks tied together by tie rods embedded in a layer of damping material and deployable tongues fastened to the disks, or finally a single layer of damping material applied directly to the housing. The damping means is such that the ratio of the height h of the mine to the diameter d formed by said means is less than 0.5.

7 Claims, 4 Drawing Figures

FIG. 3
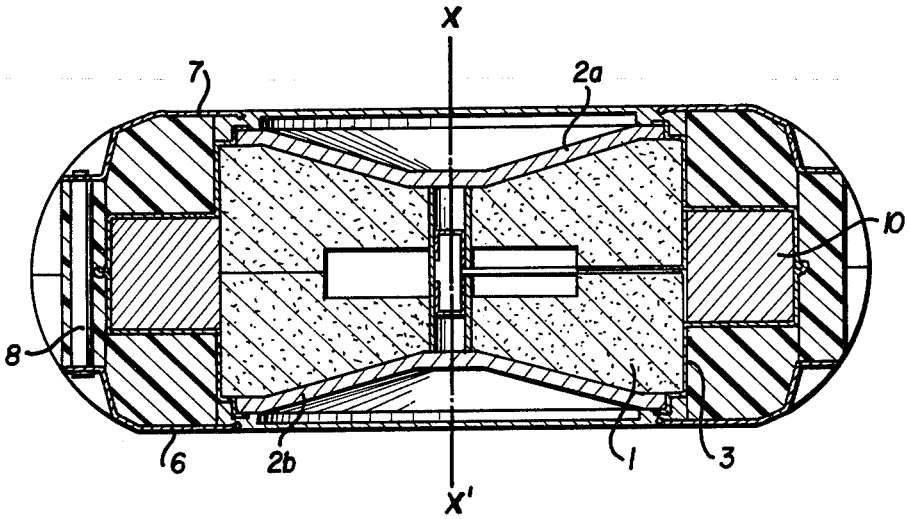
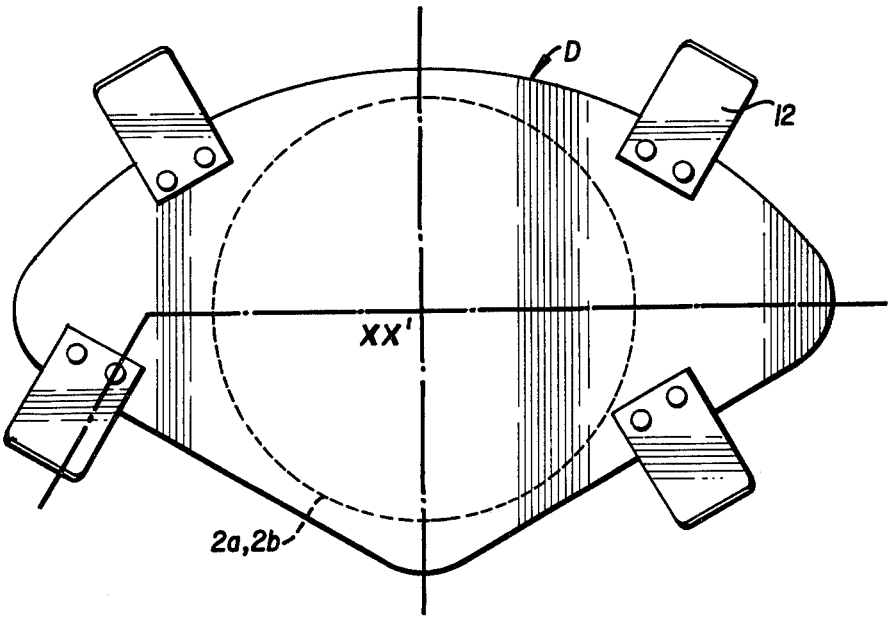
FIG. 4

BIDIRECTIONAL DISPERSIBLE SHAPED-CHARGE MINE

BACKGROUND OF THE INVENTION

The technical field of the present invention is that of mines of directed effect which can be used against armored vehicles and are capable of operating whatever the manner of laying them.

Various types of mines are already known having different manners for laying them, for instance by releasing them from airplanes, helicopters, land vehicles having a mine launcher or dispenser or from shells, rockets or missiles.

It is found that when the scattered or released mines reach the ground, their final position is frequently not that desired, this being due to the fact that the mines roll and bounce several times before coming to a stop. Two types of mines have been proposed in order to overcome this drawback, namely:

the monodirectional turnover mines and the bidirectional mines described in French Pat. No. 2 448 708.

The first type has only a single charge; in the event that upon the laying thereof the charge is not facing the target, a subsidiary device acts to assure the turning thereof. Actually this device imparts a new possibility to the mine of responsibility itself correctly, which does not imply that the desired result is necessarily obtained. The second type of mine makes it possible considerably to increase the probability of having a properly laid mine. For this purpose, the mine comprises a bidirectional shaped charge with an igniter which selects the direction of advance of the detonation towards the target to be destroyed.

In both cases there is a definite probability of the mine being laid on edge.

One object of the present invention is to remedy this problem by providing a mine which has a very high probability of being positioned under good conditions whatever its manner of dispersion and whatever the terrain to be mined.

As a matter of fact, in the event that the laying is effected on hard terrain, in particular in the case of launching by airplanes, helicopters, shells, rockets or missiles, the mines must not be damaged as a result of their contact with the ground. For this purpose, the mines previously proposed were equipped with brake devices such as parachutes or stabilizers in order to reduce the impacts which might damage the electronic circuits or the charge itself and which therefore substantially decreased the reliability of these mines.

Another object of the present invention is to provide a simple inexpensive solution to this problem while making it possible to eliminate the braking devices and of offering mines which are more compact, less complicated and more easily placed in the bodies of shells, rockets or missiles in the dispensing devices of airplanes, helicopters or trucks.

SUMMARY OF THE INVENTION

The invention is a shaped-charge mine whose action is directed along one of the two opposite directions of the axis of revolution perpendicular to the central plane of the mine, having a generally flattened shape, the mine comprising in particular a substantially cylindrical housing containing the charge, to the ends of which housing there are fastened two metallic coverings, an igniter possibly provided with a cocking rod extracted by a spring, characterized by the fact that it comprises damping means surrounding the housing and imparting the mine a ratio of weight h to outside diameter d which is less than 0.5 in order thus to assure laying along one or the other of the preferred directions.

The invention may also be characterized by a damping means which consists of a pad of material capable of damping the impacts, giving the mine a ratio of height h to outside diameter d of less than 0.5.

The mine of the invention may also be characterized by a damping means which consists of a layer of damping material surrounding the housing to which layer there are fastened flexible tongues arranged around the mine in such a manner that the ratio of the height h of the mine to the outside diameter d formed by the flexible tongues is less than 0.5.

The flexible tongues may be arranged regularly around the mine and may be fastened on opposite sides of and at a given distance from the median plane of the mine, their free ends extending away from the axis of revolution and lying substantially in the central plane of the mine.

The damping means may be formed on the one hand by a metal armoring surrounding the housing and composed of two disks arranged in planes substantially parallel to the median plane and connected together by tie-rods embedded in a damping material and on the other hand by flexible tongues fastened on the disks on opposite sides of the median plane at a given distance from them, their free ends extending away from the axis of revolution and being then substantially in the median plane of the mine.

In accordance with other features:

the material capable of damping the impacts may have recesses which can receive the flexible tongues when they are in folded position, the extractor spring for the cocking rod of the mine may consist of one of the flexible tongues, the material capable of damping the impacts may be a cellular resin or an elastomer of great elongation or a composite explosive of great length with cellular or non-cellular binder, the igniter may be arranged in the central part of the charge, around the axis of revolution of the mine and symmetrically with respect to its median plane, the outer shape of the mine may be substantially a circular sector of center angle ($2\pi/n$), n being a whole number.

BRIEF DESCRIPTION OF THE SEVERAL FIGURES

Other features and advantages of the invention will become evident from a reading of the following detailed description with reference to the accompanying drawings in which:

FIG. 1 is a partial section through the axis of revolution of a preferred embodiment of a mine in accordance with the invention, FIG. 2 is a section through a variant embodiment, FIG. 3 is a section through another variant embodiment, FIG. 4 is an outside view perpendicular to the axis of revolution of the shaped charge of a variant embodiment.

DETAILED DESCRIPTION OF THE PREFERRED EMBODIMENT

Figure 1:
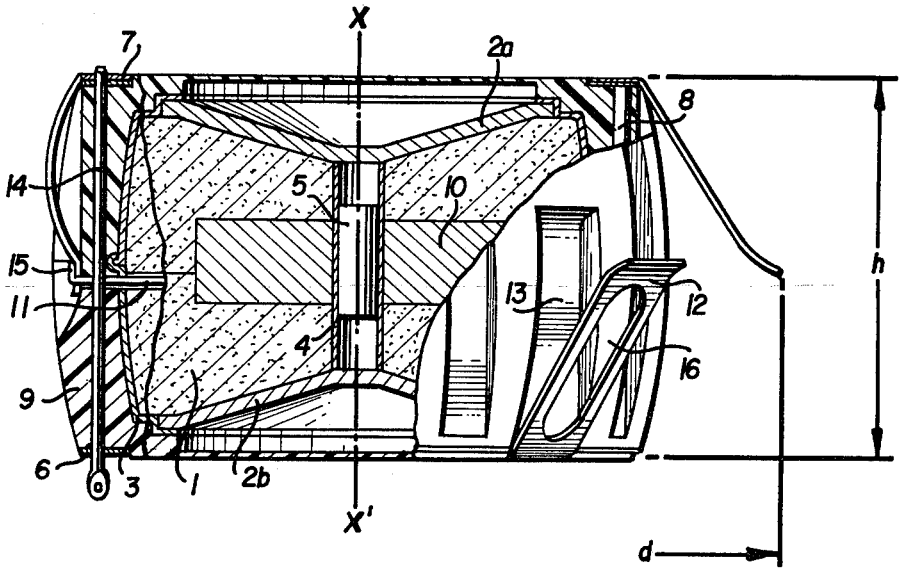

In all the examples shown in the figures, there is an explosive charge 1 contained between two coverings 2a and 2b firmly secured to a substantially cylindrical housing 3. The coverings 2a and 2b are arranged at the ends of the housing along the same axis XX' and are capable of generating shaped-charge jets extending in two opposite directions; the two coverings are in conventional manner either flat or conical and made of copper. These mines furthermore comprise a central tube 4 in which there is placed an ignition system 5 which is movable by gravity and can be held in safety position, that is to say in central position, by a suitable device which unlocks the system at the proper time. The mine has a generally flattened shape, for instance that of a truncated ellipsoid.

The mine shown in FIG. 1 is formed by—in addition to the charge previously described—two disks 6 and 7 which are uniformly held together by tierods 8 which are secured at their ends to the disks, for instance by riveting. This assembly thus forms a, for instance, metal skeleton capable of withstanding a substantial part of the forces due to impacts upon the laying thereof. This structure is embedded in a damping material 9 the damping-material/skeleton unit thus constituted being capable of suffering very violent impacts while very effectively protecting the explosive charge. For the same purpose, the igniter 10 has been placed at the center of the explosive charge where it is particularly well protected which also makes it possible to use it as waveshaping screen. The mine in accordance with the invention has a cocking rod 11 which makes it possible to have a storage safety and which acts on the primer system either directly or via the igniter 10.

This mine furthermore has flexible tongues 12 uniformly distributed on its periphery and fastened on the two disks 6 and 7. The free ends of these tongues are located approximately in the median plane of the mine and make it possible to reach an outside diameter d such that the ratio of the height h of the mine to d is at most equal to 0.5, which offers very little probability of the mine being laid on its edge. These flexible tongues can be foldable and in this case can position themselves in recesses 13 provided in the damping material. This possibility affords the advantage of being able to place this type of mine in shells, missiles, rockets or containers without the size of the mine being too great, the major part of the space available being left for the charge proper.

The cocking rod 11 is customarily ejected by a spring, a pin 14 holding it in place until mounting in a projectile or container. In this type of mine, the flexibility of the tongues has been utilized to facilitate the extraction of the rod; the T-shaped outer end 15 is engaged in the recessed portion 6 of the corresponding flexible tongue so as to permit ejection through the recessed portion 16.

As a variant, the tongues can be fastened on the layer itself of damping material 9, eliminating the skeleton 6, 7, 8, which makes it possible to facilitate the manufacture and decrease the cost.

Materials of the cellular or elastomeric resin type of large elongation are remarkably suitable for the stock-damping material.

Figure 2:
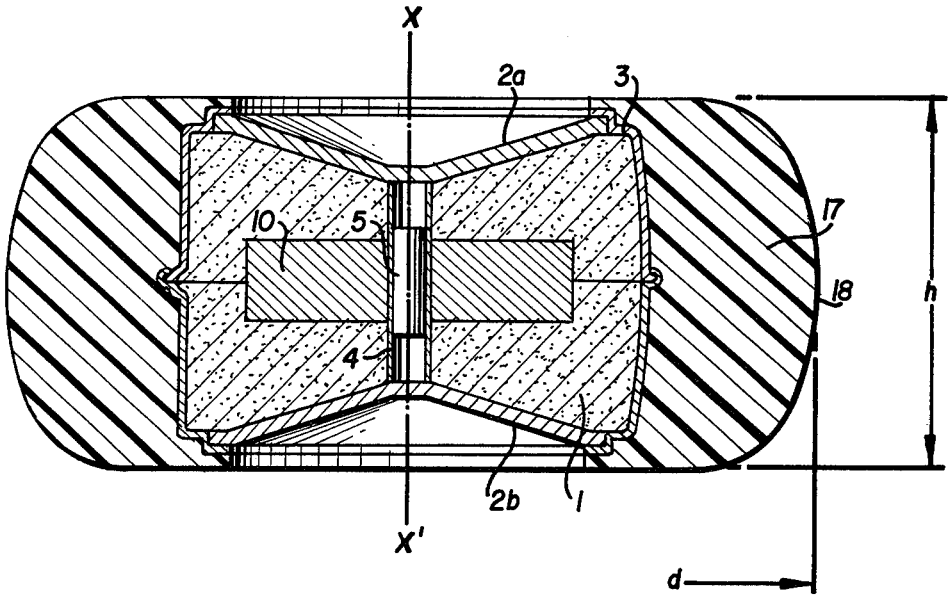

The mine in accordance with FIG. 2 comprises an explosive charge which is substantially identical to the preceding one. In the case of this embodiment a ratio h/d has been obtained of less than 0.5 by strapping the charge with a pad of damping material. It is particularly advantageous in this variant for the damping material 17 to consist of a composite explosive of great elongation so as to obtain a ratio of weight of explosive to total weight of the mine which is as high as possible, thereby achieving maximum effectiveness, the charge constituting the padding being in particular used for action against caterpillar tracks. In order to avoid positioning on edge, the edges 18 of the mine are rounded.

The semi-rigid structure of the mine shown in FIG. 3 is constituted in a manner identical to that of FIG. 1, namely by two metal discs 6 and 7 of suitable shape held together by tierods 8. The ratio h/d has been decreased by placing the igniter 10 in the center of the damping material outside the shaped charge. As compared with FIG. 1, the flexible tongues have been eliminated, the outer shape of the mine being that described in FIG. 2.

The mine shown in FIG. 4 is developed in such a manner that it can be housed in a cylindrical container such as the warhead of a rocket or a missile. Its outer shape is that of a circular sector of diameter D corresponding to the inside diameter of the container within which this type of mine is placed. In this particular case, the circular sector has a center angle equal to $(2\pi/3)$ so as to be able to place three mines side by side. It will be clear that the number of mines can be varied, with due consideration of the available diameter of the container. This type of mine is equipped with foldable flexible tongues 10 which contribute with the very flattened outer shape to permit positioning under excellent conditions. The construction of the semi-rigid structure can be that used for the construction of one of the mines described previously.

I claim:

1. A shaped charge mine with action directed along one of the two opposite directions of the axis of revolution perpendicular to the central plane of the mine which is of generally flattened shape, including a substantially cylindrical housing containing the charge to the ends of which housing there are fastened two metal coverings, an igniter provided with a cocking rod extracted by a spring, said mine being characterized by the fact that it comprises a damping means surrounding the housing and imparting to the mine a ratio of height h to outside diameter d which is less than 0.5 in order to assure laying along one or the other of the preferred directions, wherein the damping means consists of a layer of damping material surrounding the housing, on which layer flexible tongues ar fastened on opposite sides of the central plane and at a given distance from it, said flexible tongues having free ends which extend away from the axis of revolution and which are substantially oriented in the median plane of the mine.

2. A shaped charge mine with action directed along one of the two opposite directions of the axis of revolution perpendicular to the central plane of the mine which is of generally flattened shape, including a substantially cylindrical housing containing the charge to the ends of which housing there are fastened two metal coverings, an igniter provided with a cocking rod extracted by a spring, said mine being characterized by the fact that it comprises a damping means surrounding the housing and imparting to the mine a ratio of height h to outside diameter d which is less than 0.5 in order to assure laying along one or the other of the preferred directions, wherein the damping means consists of a metallic armoring surrounding the housing and composed of two disks arranged in planes substantially parallel to the median plane of the mine and connected to each other by tierods embedded in a damping material and wherein flexible tongues are fastened on the disks on opposite sides of the median plane and at a given distance from it, said flexible tongues having free ends which extend away from the axis of revolution and which are substantially oriented in the median plane of the mine.

3. A mine according to claim 2, wherein the damping material has recesses which can receive the flexible tongues when they are in a folded position.

4. A mine according to claim 3, wherein the extractor spring of the cocking rod of the mine consists of one of the flexible tongues.

5. A mine according to each of the claims 1 to 4, wherein the damping material is a cellular resin or an elastomer of large elongation.

6. A mine according to claim 5, wherein the damping material is a composite explosive of great elongation with cellular or non-cellular binder.

7. A mine according to claim 6, wherein the outer shape of the mine is substantially a circular sector of center angle equal to $2\pi/n$, n being a whole number.

* * * * *